US010888114B2

(12) United States Patent
Chipman

(10) Patent No.: US 10,888,114 B2
(45) Date of Patent: Jan. 12, 2021

(54) STORAGE TUBE AND SAVER FOR SMOKING MATERIAL

(71) Applicant: Lloyd D. Chipman, Manchester, NH (US)

(72) Inventor: Lloyd D. Chipman, Manchester, NH (US)

( * ) Notice: Subject to any disclaimer, the term of this patent is extended or adjusted under 35 U.S.C. 154(b) by 99 days.

(21) Appl. No.: 15/292,240

(22) Filed: Oct. 13, 2016

(65) Prior Publication Data

US 2019/0183172 A1 Jun. 20, 2019

(51) Int. Cl.
*A24F 15/12* (2006.01)
*A24F 13/18* (2006.01)

(52) U.S. Cl.
CPC ..... *A24F 15/12* (2013.01); *A24F 13/18* (2013.01)

(58) Field of Classification Search
CPC ..... A24F 15/00; A24F 15/08; A24F 15/12; A24F 15/18; A24F 15/20; A24F 19/0035; A24F 19/0064; A24F 19/0085; A24F 19/02; A24F 19/025; A24F 13/02; A24F 13/08; A24F 13/12; A24F 13/14; A24F 13/16; A24F 13/18; B65D 85/12
See application file for complete search history.

(56) References Cited

U.S. PATENT DOCUMENTS 1,545,452 A * 7/1925 Pinn ..... A24F 19/0064 131/231
2,016,819 A 10/1935 Meginniss
2,152,285 A * 3/1939 Schirmer ..... A24F 19/00 131/240.1
4,682,611 A * 7/1987 Chiu-Rong ..... A24F 13/14 131/175
4,711,254 A 12/1987 Fleisher et al.
4,907,604 A * 3/1990 Beloff ..... A24F 13/18 131/233
4,982,746 A * 1/1991 Pruyne ..... A24F 13/18 131/235.1
5,385,157 A * 1/1995 Smith ..... A24F 13/18 131/235.1
8,540,075 B2 9/2013 Chau
(Continued)

FOREIGN PATENT DOCUMENTS

EP 1842438 A1 10/2007
FR 878017 A * 1/1943 ..... A24F 13/18
(Continued)

*Primary Examiner* — Allan D Stevens
(74) *Attorney, Agent, or Firm* — Robert R. Deleault, Esq.; Mesmer & Deleault, PLLC

(57) ABSTRACT

A storage tube for a smoking material includes a hollow tube extending along a central longitudinal axis from an open first tube end to a closed or closable second tube end. The tube has a sidewall with an inside surface and a cross-sectional dimension sized to receive a smoking material, wherein the second tube end has a lower inside end surface extending transversely to the central longitudinal axis. An upper end cap is removably attachable to the first tube end and forms an air-tight seal. A rigid protrusion extends axially into the tube from the lower inside end surface and has a protrusion body and a protrusion tip. The protrusion defines a gap between the protrusion body and the inside surface of the sidewall. Optionally, the protrusion is removable.

20 Claims, 4 Drawing Sheets

(56) References Cited

U.S. PATENT DOCUMENTS

| | | | | |
|---|---|---|---|---|
| 2005/0051183 | A1* | 3/2005 | Coulthard | A24F 13/18<br>131/256 |
| 2013/0167850 | A1* | 7/2013 | Al-Aawar | A24F 13/16<br>131/175 |

FOREIGN PATENT DOCUMENTS

| | | | | | |
|---|---|---|---|---|---|
| GB | 320843 | A | * | 10/1929 | A24F 19/00 |
| GB | 331249 | A | * | 6/1930 | A24F 19/00 |
| WO | 1998054989 | A1 | | 12/1998 | |
| WO | WO-2018060805 | A1 | * | 4/2018 | A24F 13/18 |

* cited by examiner

STORAGE TUBE AND SAVER FOR SMOKING MATERIAL

BACKGROUND OF THE INVENTION

1. Field of the Invention

The present invention relates generally to storage containers for smoking material. More specifically, the present invention relates to a storage tube and saver for smoking materials, such as cigars.

2. Description of the Prior Art

Smoking cigars is an enjoyable pastime that accompanies social outings, sports, driving, camping, or simply relaxing. A fine cigar may cost as much as $80-$100. At times, the smoker may be only part way through a cigar when he/she is called to an area where smoking is not permitted, such as inside a retail store. At these moments, the smoker may put out the cigar and wish to return to the cigar to finish smoking it at a later time.

To address such a situation, cigar tubes, pockets, hand bags, and other methods of storing the unfinished cigar have been used with varying degrees of success. In some cases, the cigar is damaged by unsafe storage methods. In other cases, the ash from the burned end of the cigar makes a mess of clothing and hand bags.

One approach to the problem of saving a partially-smoked cigar is described in U.S. Pat. No. 1,342,512 to Johan Skinderviken (1920). The cigar saver and holder is intended to receive lighted cigars and be carried in the pocket of the user's clothing. The container includes a cylindrical tube with rounded, closed ends. One end of the tube defines a removable cap. A clamp is installed at the inside end of the removable cap and features jaws that extend axially into the cap for gripping the butt end of the cigar or cigarette that is received in the user's mouth. A spring biases the jaws towards the closed position to engage the cigar, but the jaws may be spread apart against the force of the spring to receive the butt end of the cigar. After gripping the butt end of the cigar with the jaws, the lit end and body of the cigar is placed into the remaining portion of the tube and the cap is attached. In this condition, the cigar is extinguished from lack of oxygen. The jaws hold the cigar so that the lit end is suspended or spaced from the closed end of the tube and so that the cigar does not press against any part of the tube. Accordingly, the storage tube avoids fracturing the cigar wrapper or crushing the butt-end of the cigar.

A more recent adaptation of a cigar extinguisher and saver device is described in U.S. patent application publication no. 2007/0034216 A1 to Lily Liu et al. (2007). The assembly includes two hollow, cylindrical tubes that fit together so that the upper tube can shorten or lengthen the assembly by sliding telescopically along the lower tube. The upper tube is open at both ends and includes a removable cap at the top end. The lower tube is received in the open bottom end of the upper tube. The lower tube is open at the top end and has a removable cap at the bottom end with a concave inner surface forming a snuffer. In use, the user removes the cap on the upper tube and places a lit cigar in the hollow tubular assembly where the cigar is extinguished quickly. The tube may be adjusted to the length of the cigar placed therein.

SUMMARY OF THE INVENTION

A problem with cigar holders and savers of the prior art is that little attention is given to the lit end of the cigar and ash that falls from the lit end when the cigar is placed into the tube. The Skinderviken cigar tube suspends the lit end of the cigar from the tube's closed end. However, the spring jaws tend to damage the butt end of the cigar. When the jaws have a light enough grip to avoid damage to the cigar, the jaws frequently fail to hold the cigar and the cigar falls to the bottom end of the tube with the formerly-lit end of the cigar immersed in ash.

When the inside bottom end of the tube is flat or concave, the lit end of the cigar makes contact with the blunt surface and causes ash to fall from the lit end. Due to the flat or concave shape of the inside end of the tube, the ash collects at the bottom of the tube and clings to the formerly lit end of the cigar, which also occupies the bottom of the tube. Therefore, when the now-extinguished cigar is removed from the tube for later use, the formerly-lit end is caked with ash. Not only is this unsightly, but the ash may fall from the cigar and soil clothing or furniture.

Therefore, what is needed is a tube for storing and saving smoking material, such as cigars. An object of the present invention is to provide a storage tube that extinguishes a lit cigar or other smoking material and retains it for later use.

The present invention achieves these and other objectives by providing a storage tube for smoking material, where the storage tube has a protrusion extending into the tube from the lower end, and where a smoking material can be supported on the protrusion.

In one embodiment, a storage tube for a smoking material includes a hollow tube extending along a central longitudinal axis from a first tube end portion to a second tube end portion, where the tube has an inside surface and a cross-sectional dimension sized to receive a smoking material, such as a cigar of a predefined ring gauge. An upper end cap is removably attachable to the first tube end portion and forms an air-tight seal. A lower end of the tube has either a closed end or a lower end cap that is removably attachable to the second tube end with an air-tight seal. The closed second end or the lower end cap has a lower inside end surface extending transversely to the central longitudinal axis. A rigid protrusion extends axially into the tube from the lower inside end surface and defines a gap between the protrusion body and the inside surface of the tube. The protrusion has a protrusion body and a protrusion tip.

In some embodiments, the tube is sized to receive a smoking material of a predefined length and ring gauge.

In one embodiment, the protrusion body slopes to the protrusion tip. In some embodiments, the protrusion tip is rounded and has a radius of curvature from 0.1 inch to 0.2 inch. In other embodiments, the protrusion tip is a flat surface generally perpendicular to the central longitudinal axis and has a diameter from 0.15 inch to 0.3 inch.

In some embodiments, the protrusion tip has a diameter smaller than a diameter of the protrusion body. In other embodiments, the protrusion tip has a diameter greater than a diameter of the protrusion body.

In another embodiment, the protrusion body is frustoconical and the protrusion tip is a flat or a dome.

In another embodiment, the rigid protrusion is a distinct structure from the lower end cap or the hollow tube and is sized to be received on the lower inside end surface. In one embodiment in which the tube includes a removable lower end cap, for example, the rigid protrusion includes a lower protrusion flange extending at least partially around a bottom protrusion end of the protrusion, where the tube defines a lip constructed to trap the lower protrusion flange between the tube and the lower end cap to retain the protrusion in the lower end portion of the tube.

In another embodiment, the rigid protrusion is removable from the holder and is sized to be received on the lower inside end surface. For example, the protrusion can be installed into the lower end portion of the hollow tube, where the protrusion is received on the lower inside end surface. In other embodiments, the protrusion is removable or separable from the lower end cap.

In some embodiments, the hollow tube has a circular, square, triangular, polygonal, or other cross-sectional shape.

DETAILED DESCRIPTION OF THE PREFERRED EMBODIMENTS

Figure 1:
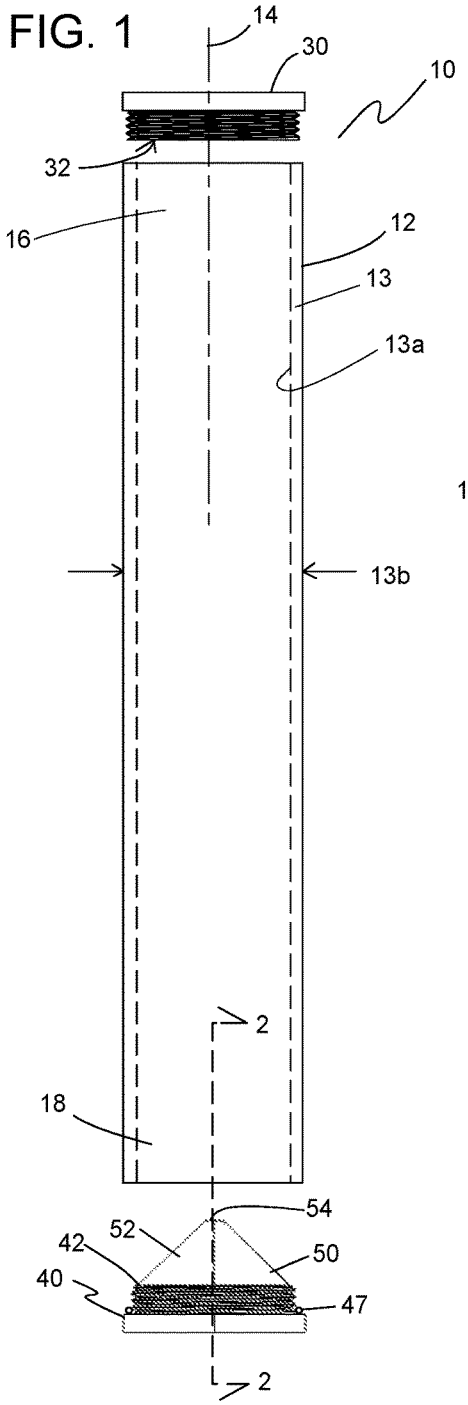
FIG. 1 is a front perspective of one embodiment of a storage tube for smoking material of the present invention.

The preferred embodiments of the present invention are illustrated in FIGS. 1-6. FIG. 1 illustrates an elevational view of one embodiment of a storage tube 10 for smoking material, such as a cigar, cigarette, or the like. The storage tube 10 includes a hollow tube 12 extending along a central longitudinal axis 14 from a first or upper tube end portion 16 to a second or lower tube end portion 18. In one embodiment, the tube 12 is cylindrical, however, other cross-sectional shapes are acceptable, such as rectangular or hexagonal. In one exemplary embodiment, the tube 12 has one or more sidewall 13 with inside surface 13*a*, where the sidewall 13 has a thickness of about 0.15-0.175 inch when outside diameter 13*b* is about 1.25 inch. Accordingly, the tube 12 is preferably sized to receive a smoking material 5 (e.g., a cigar shown in FIG. 4) of a predefined length and ring gauge and to allow the smoking material 5 to easily slide out of the tube 12 when the tube 12 is inverted.

An upper-end cap 30 is removably attachable to the first end portion 16 and preferably forms an air-tight seal with the tube 12 when attached. The tube 12 has either a closed second end portion 18 or a lower-end cap 40 that is removably attachable to the second end portion 18. Preferably the lower-end cap 40 is capable of forming an air-tight seal with the tube 12 when attached. In one embodiment, upper-end and lower-end caps 30, 40 engage the tube 12 with threads, a slip fit, a press fit, an interference fit, or other suitable method that retains the caps 30, 40 on the tube 12. Optionally a sealing member 47, such as a gasket, elastomeric seal, or O-ring (shown in FIG. 2), may be employed to provide an air-tight seal between caps 30, 40 and tube 12. Upper end cap 30 has an upper inside end surface 32 and lower end cap 40 has a lower inside end surface 42, where the inside end surfaces 32, 42 generally extend across the tube 12 transverse to the central longitudinal axis 14. In one embodiment, the upper inside end surface 32 is flat and extends perpendicular to the central longitudinal axis 14. In other embodiments, the upper inside end surface 32 is concave or domed for receiving a rounded butt-end 8 of a cigar or other smoking material 5 (shown, e.g., in FIG. 5.) A rigid protrusion 50 extends axially from the lower inside end surface 42 and includes a protrusion body 52 with a protrusion body surface 52*a* that extends axially to a protrusion tip 54.

Figure 2:
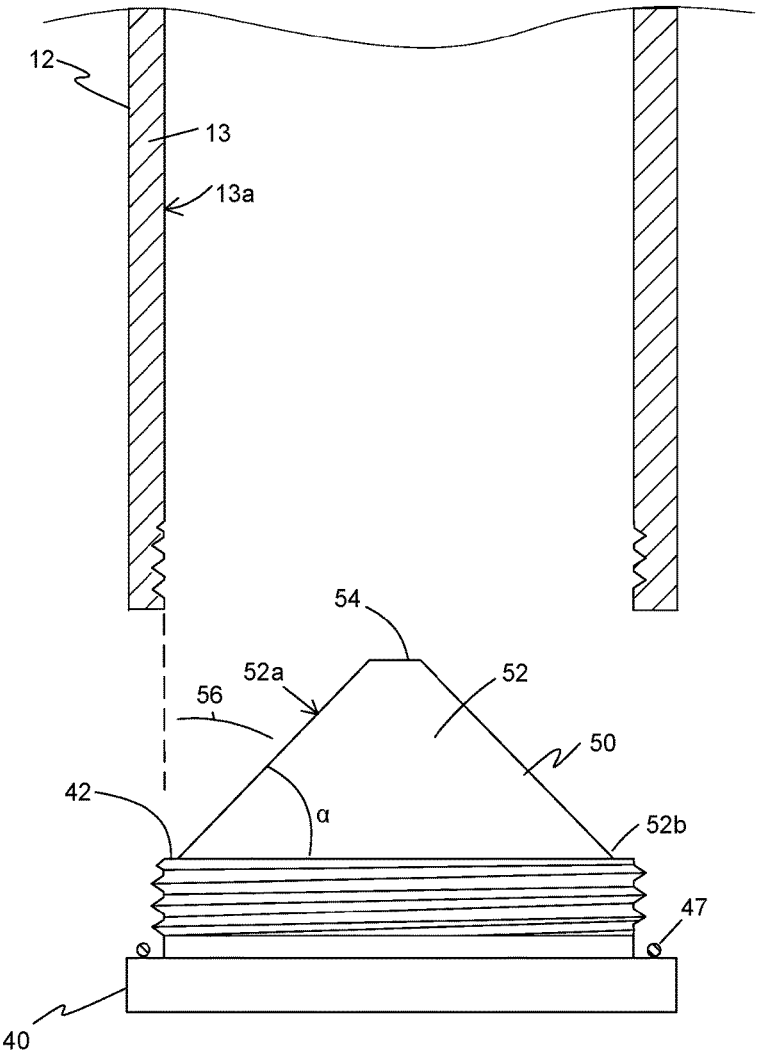
FIG. 2 is a lower end portion of one embodiment of a storage tube showing the tube as a cross section and the lower end cap separated from the lower tube end portion.

Referring now to FIG. 2, a partial sectional view taken along line 2-2 in FIG. 1 illustrates a part of the tube 12 together with one embodiment of the lower end cap 40. When the lower end cap 40 is assembled with the tube 12 (or when tube 12 has a closed second end portion 18), the protrusion 50 defines a gap 56 between the inside surface 13*a* of the sidewall 13 and the protrusion body 52. When the smoking material is placed in the storage tube 10 oriented in a vertical position, the protrusion 50 supports the smoking material on the protrusion tip 54. As such, the smoking material (e.g., a cigar) is elevated above the lower inside end surface 42 and ash collects in the gap 56.

In one embodiment, the gap 56 extends completely around the protrusion body 52 in a circumferential direction. That is, no portion of the protrusion body 52 or the protrusion tip 54 extends to contact or nearly contact the sidewall 13. In other embodiments, the gap 56 comprises two or more distinct gap compartments (not shown), such as when the protrusion 50 defines a wall or plus shape that extends between opposite portions of the sidewall(s) 13. In some embodiments, the protrusion body 52 extends at its lower end 52*b* substantially to the inside surface 13*a* of the sidewall 13 so that the protrusion 50 defines or comprises the entire lower inside end surface 42. In one embodiment, the protrusion body surface 52*a* and inside end surface 42 define an angle $\alpha$ of about 45°. Other values of angle $\alpha$ are acceptable.

In one embodiment, the tube 12 and the end caps 30, 40 are made of aluminum, copper, titanium, steel, or other metal. Other materials are acceptable for the tube 12 and the end caps 30, 40, particularly flame-resistant materials, such as some carbon fiber composites, glass, and some polymers.

Turning now to FIGS. 3A-3G, exemplary embodiments of the lower end cap 40 are shown in perspective illustrations. Although the embodiments of the lower end cap 40 are illustrated as having a threaded sidewall and circular cross-sectional shape to engage a cylindrical tube 12, other geometries and fits are contemplated. For example, the lower end cap 40 may be configured for an interference fit with the tube 12 having a square, triangular, polygonal, or other cross-sectional shape. In general, the protrusion 50 may be a solid or hollow structure depending on cost and manufacturing constraints, the desired capacity to absorb heat from the smoking material, and other considerations.

Figure 3A:
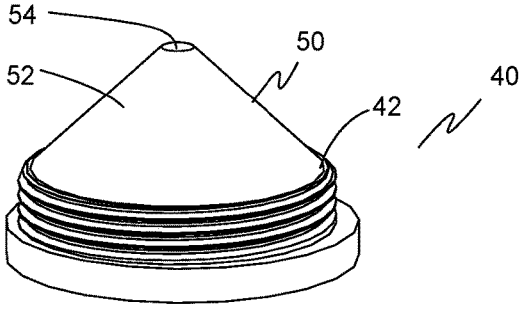
FIGS. 3A-3G are perspective illustrations of various exemplary embodiments of a lower end cap with protrusion of the present invention.

FIG. 3A illustrates an embodiment of the lower end cap 40 where the protrusion 50 generally has a frustoconical shape. The protrusion body surface 52*a* extends linearly from the lower inside end surface 42 to a flat protrusion tip 54 having a round shape with a diameter of about 0.10-0.20 inch.

Figure 3B:
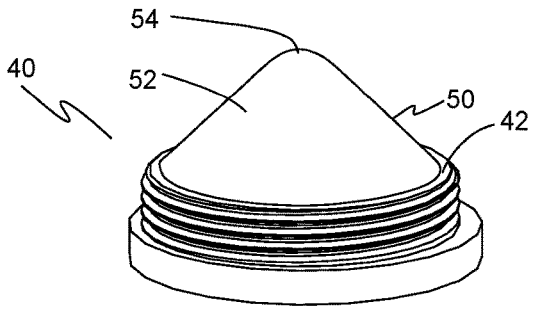

FIG. 3B illustrates an embodiment of the lower end cap 40 similar to the embodiment shown in FIG. 3A, except that protrusion tip 54 is domed or rounded. In one embodiment, the protrusion tip 54 has a radius of curvature from about 0.18 to about 0.20 inch.

Figure 3C:
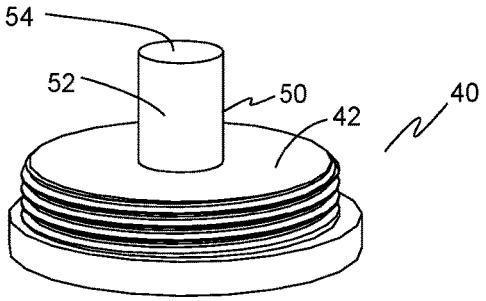

FIG. 3C illustrates another embodiment of the lower end cap 40 where the protrusion body 52 is shaped as a cylindrical post extending to a flat protrusion tip 54 that extends substantially perpendicularly to the central longitudinal axis 14 of the tube 12 when assembled together. Similarly, the protrusion body 52 could have a rectangular, hexagonal, octagonal, or other cross-sectional shape. In one preferred embodiment, the protrusion 50 is centered on the lower inside end surface 42.

Figure 3D:
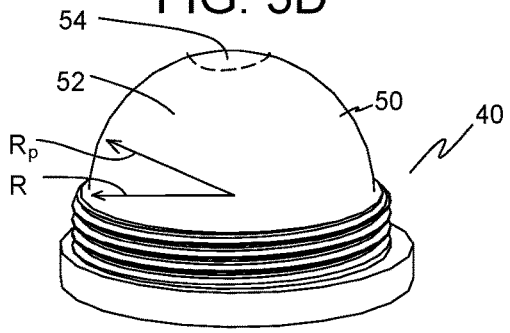

FIG. 3D illustrates another embodiment of the lower end cap 40 where the protrusion 50 has a rounded or domed shape that substantially defines a hemisphere with a radius $R_p$ substantially equal to the radius R of the lower inside end surface 42. In this embodiment, the protrusion tip 54 is an area on the protrusion 50 that makes contact with the lit end of the smoking material. Typically, the area of the protrusion tip 54 making contact with the smoking material is within a diameter of about 0.2 inch.

Figure 3E:
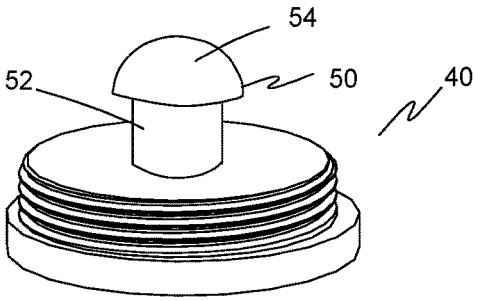

FIG. 3E illustrates yet another embodiment of the lower end cap 40 where the protrusion 50 has a domed protrusion tip 54 connected atop a protrusion body 52 of a reduced diameter, where the protrusion 50 approximates the appearance of a mushroom. In some embodiments, the protrusion body 52 is cylindrical, however, other cross-sectional shapes are acceptable, including solid and hollow variations thereof.

Figure 3F:
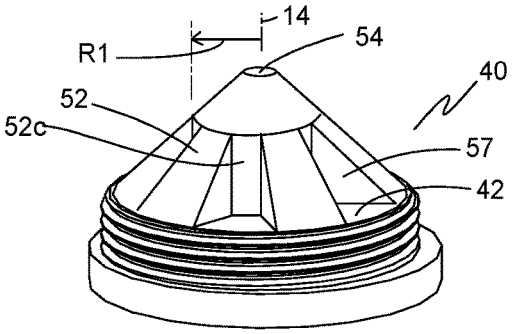

FIG. 3F illustrates yet another embodiment of the lower end cap 40 similar to the embodiment of FIG. 3A, where the protrusion 50 has a generally frustoconical shape except that the protrusion body 52 includes a plurality of wedge-shaped recesses 57 extending radially out from a central protrusion body portion 52*c*. As illustrated, the central protrusion body portion 52*c* has a cylindrical shape, but it may have other polygonal shapes. In one embodiment, the recesses 57 begin at a radius $R_1$ of about 0.1-0.3 inch from the central longitudinal axis 14. The recesses 57 capture ash falling from the smoking material while also allowing the protrusion 50 to more effectively dissipate heat to the surrounding air and tube 12.

Figure 3G:
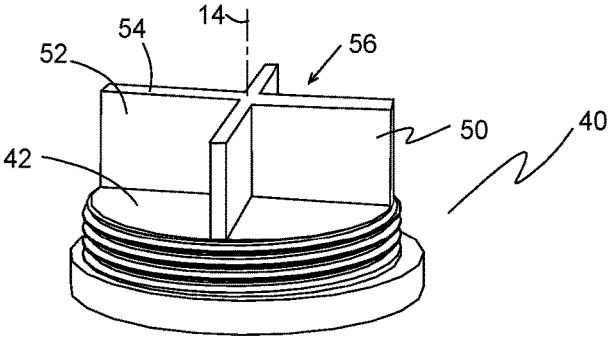

FIG. 3G illustrates yet another embodiment of the lower end cap 40 where the protrusion 50 has a plus shape as viewed from above, where the plus shape is defined by two intersecting walls extending axially from the lower inside end surface 42. In this embodiment, the protrusion body 52 is defined by intersecting walls in a plus shape (+) and the protrusion tip 54 is defined by the plus-shaped top surface of the walls. Such an embodiment provides a larger gap 56 than some other embodiments and therefore is able to receive more ash from the smoking material. Similarly, the protrusion could have a star shape or other shape constructed from a plurality of walls that intersect or meet at or near the central longitudinal axis 14.

Figure 4:
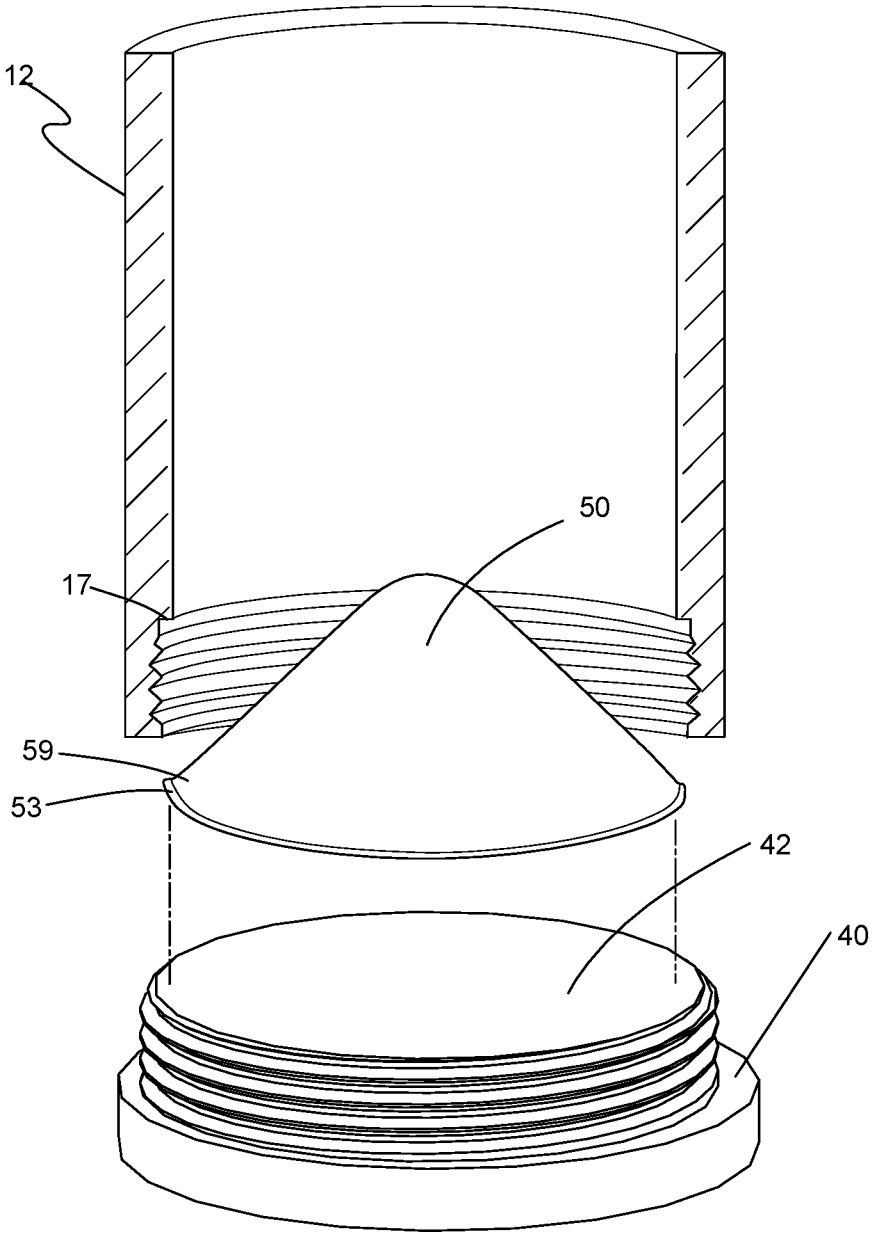
FIG. 4 is a front perspective illustration of an embodiment of a lower end cap of the present invention showing a partial sectional view of the hollow tube and showing that the protrusion is removable from the holder.

Referring now to FIG. 4, a front perspective illustration shows another embodiment of the lower end cap 40 and the protrusion 50, where the protrusion 50 is a distinct structure from the lower end cap 40. For example, the protrusion 50 is sized to be received on the lower inside end surface 42 of the lower end cap 40 or closed lower end portion 18 (shown in FIG. 1) of the tube 12. In some embodiments, the protrusion 50 includes a lower protrusion flange 53 that extends partially or completely around a lower protrusion end 59. For example, the lower protrusion flange 53 has an annular shape that extends radially outward from and circumferentially around a lower protrusion end 59. In one embodiment, the lower protrusion flange 53 is constructed to be trapped between lower end cap 40 and a corresponding lip 17, surface, or feature on tube 12, thereby securing the protrusion 50 in the lower end portion 18 of the tube 12.

In other embodiments, the protrusion 50 engages the lower inside end surface 42 with a snap fit, threaded engagement, or other suitable engagement to removably retain the protrusion 50 on the lower end cap 40.

In yet other embodiments, the protrusion 50 is placed unrestrained on the lower inside end surface 42 and is held in position by the smoking material 5 being placed into the storage tube 10. By making the protrusion 50 separate and removable from the lower end cap 40 and/or storage tube 10, the user may select the protrusion 50 with a shape that is best for the chosen smoking material and/or best suits the user's aesthetic taste.

Figure 5:
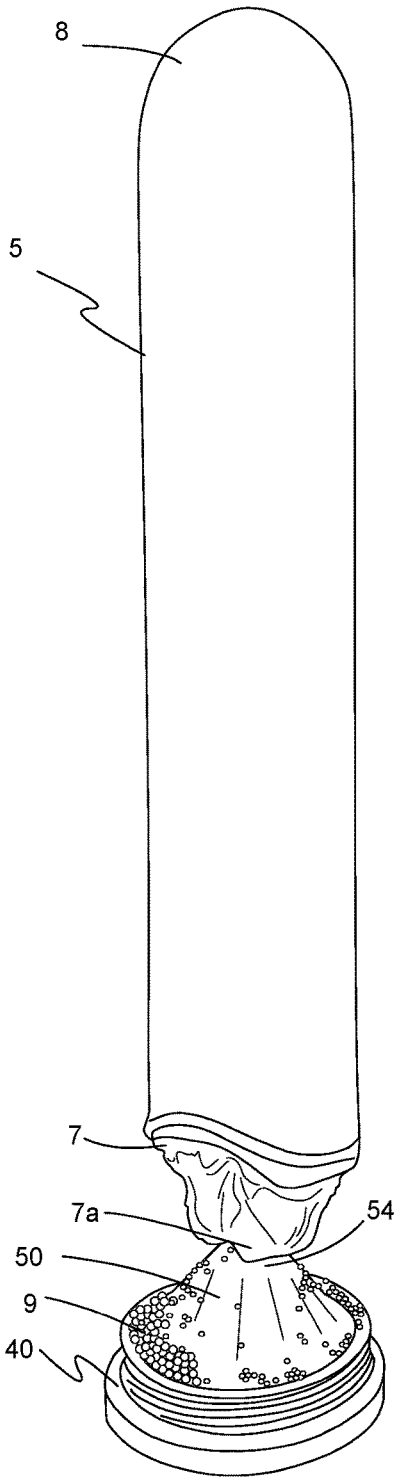
FIG. 5 is a front perspective view of a cigar supported by the protrusion of an end cap of the present invention.
Figure 6:
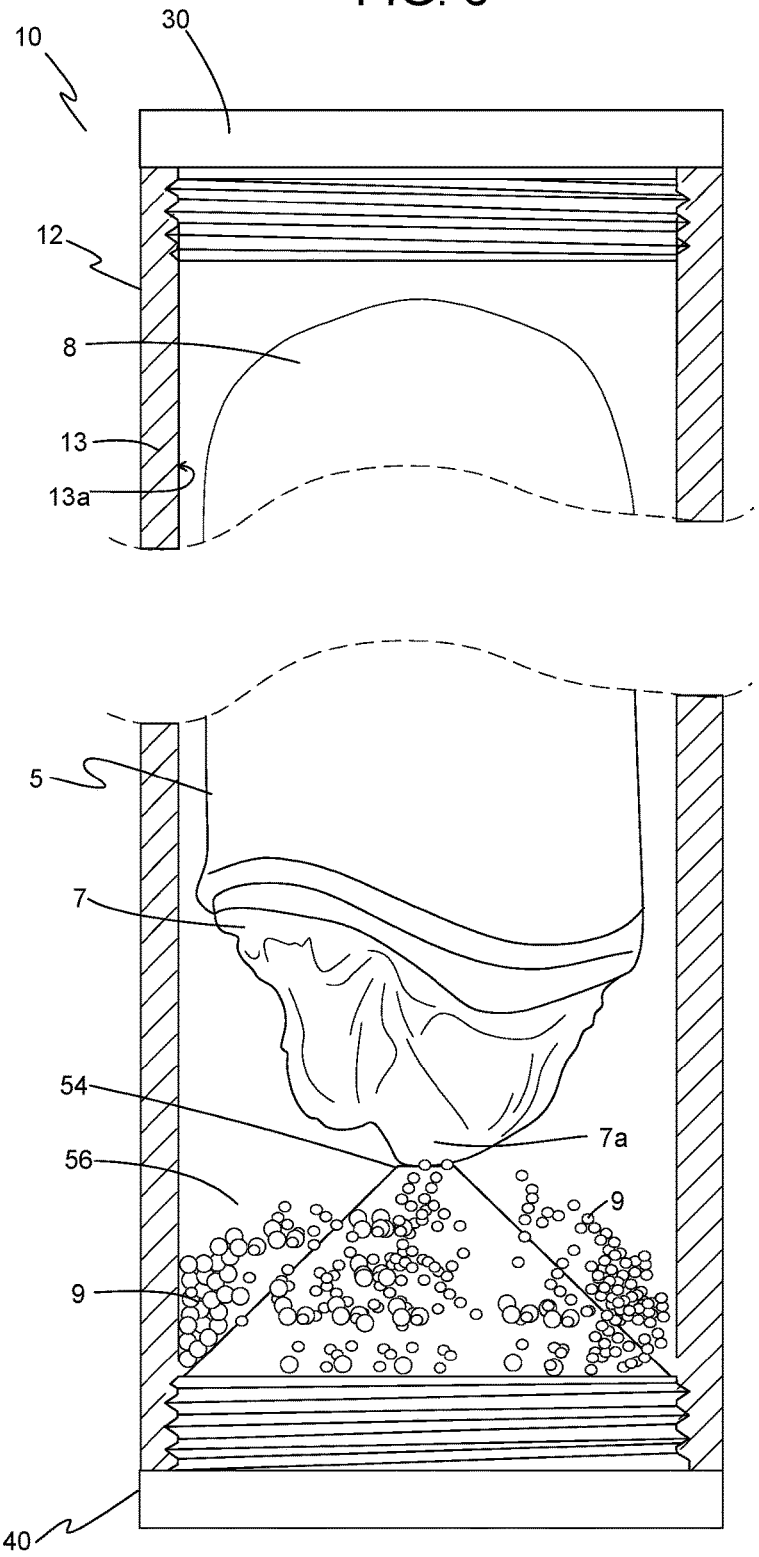
FIG. 6 is a front split view of one embodiment of a lower end cap and an upper end cap of the present invention connected to a partial cross-sectional view of the hollow tube of the present invention with a cigar retained within the storage tube and supported on the protrusion tip.

Referring now to FIGS. 5 and 6, one embodiment of the lower end cap 40 is shown in use with smoking material 5 (e.g., a cigar) supported at its lit end 7 by the protrusion 50. The tube 12 and upper end cap 30 are omitted from view in FIG. 5 for clarity. FIG. 6 illustrates a cross-sectional view of the tube 12 with the upper end cap 30 and the lower end cap 40 installed. In both of FIGS. 5 and 6, the smoking material 5 is oriented vertically with the lit end 7 pointing downwards and supported by the protrusion 50.

As the smoking material 5 burns, the lit end 7 assumes a somewhat conical or tapered shape with the outside portion of the lit end 7 becoming ash. The tip 7*a* of the lit end 7 of the smoking material 5 can be brought into contact with and supported by the protrusion tip 54. When the lit smoking material 5 is placed into the storage tube 10, ash 9 falls from the lit end 7 and accumulates in the gap 56 between the protrusion 50 and the inside surface 13*a* of the sidewall(s) 13. Since the protrusion tip 54 is elevated relative to the lower inside end surface 42, ash 9 collects in the gap 56 away from the lit end 7.

When made of appropriate materials, the protrusion 50 conducts heat away from the lit end 7 and dissipates it to the tube 12 and the surrounding environment. As such, the storage tube 10 stays cool to the touch even after inserting a lighted smoking material. After inserting the smoking material 5 into the tube 12, the upper end cap 30 is installed to seal the tube 12 from the outside air, thereby snuffing out the smoking material 5. Since the storage tube 10 is preferably sized for a specific length and ring gauge of smoking material 5, the smoking material 5 remains positioned on the protrusion tip 54 with little space to move.

In use, the user removes the upper end cap 30 from the storage tube 10 and inserts a lighted smoking material 5, such as a cigar. The smoking material 5 is supported by the tip 7*a* of the lit end 7, which contacts the protrusion tip 54. After installing the upper end cap 30 on the tube 12, the smoking material 5 is extinguished. The user may then stow the storage tube 10 with smoking material 5 in a pocket or other location so that the user may return to continue smoking the smoking material 5 at a later time. Embodiments of the storage tube 10 safely receive and extinguish lighted smoking material 5 and collect ash 9 away from the lit end 7 without heat of the smoking material 5 burning the user or the user's clothing or fabrics. The storage tube 10 also avoids excessive accumulation of ash 9 on the lit end 7 of the smoking material 5 and retains the ash 9 for later disposal where it does not soil clothing, handbags, or the like.

Although the preferred embodiments of the present invention have been described herein, the above description is merely illustrative. Further modification of the invention herein disclosed will occur to those skilled in the respective arts and all such modifications are deemed to be within the scope of the invention as defined by the appended claims.

I claim:

1. In combination, a storage tube and a cigar, the combination comprising:

the cigar having a lit end; and the storage tube containing the cigar, the storage tube comprising:

a hollow tube extending along a central longitudinal axis from a first tube end portion to a second tube end portion, wherein the hollow tube has an inside surface and a predefined cross-sectional dimension sized to accommodate the cigar of a predefined ring gauge so that the lit end of the cigar contacts and is on a protrusion tip when the cigar is at a lowermost position within the storage tube;

an upper end cap removably attachable to the first tube end portion while forming an air-tight seal;

a lower end cap removably attachable to the second tube end portion while forming a second air-tight seal, the lower end cap having a lower inside end surface extending transversely to the central longitudinal axis; and a rigid protrusion contacts the lit end of the cigar, the rigid protrusion has a protrusion body and the protrusion tip, wherein the protrusion body is constructed to extend axially into the hollow tube from the lower inside end surface and defines a gap between the protrusion body and the inside surface of the hollow tube when the lower end cap is installed on the second tube end portion.

2. The combination of claim 1, wherein the protrusion body slopes to the protrusion tip.

3. The combination of claim 2, wherein the protrusion tip is rounded and has a radius of curvature from 0.1 inch to 0.2 inch.

4. The combination of claim 2, wherein the protrusion body is frustoconical.

5. The combination of claim 2, wherein the protrusion tip is flat.

6. The combination of claim 1, wherein the protrusion tip has a diameter smaller than a diameter of the protrusion body.

7. The combination of claim 1, wherein the protrusion tip has a diameter greater than a diameter of the protrusion body.

8. The combination of claim 1, wherein the protrusion tip is a flat surface perpendicular to the central longitudinal axis and has a diameter from 0.15 inch to 0.3 inch.

9. The combination of claim 1, wherein the rigid protrusion is a distinct structure from the lower end cap and is sized to be received on the lower inside end surface.

10. The combination of claim 9, wherein the rigid protrusion includes a lower protrusion flange extending at least partially around a bottom protrusion end of the protrusion and wherein the hollow tube defines a lip constructed to trap the lower protrusion flange between the hollow tube and the lower end cap, thereby retaining the protrusion in a lower end portion of the hollow tube.

11. A storage tube for a cigar comprising:

a hollow tube extending along a central longitudinal axis from an open first tube end to a closed second tube end, wherein the hollow tube has a sidewall with an inside surface and a cross-sectional dimension sized to receive a cigar, wherein the closed second tube end has a lower inside end surface extending transversely to the central longitudinal axis;

an upper end cap removably attachable to the first tube end while forming an air-tight seal;

a rigid protrusion is configured to contact a lit end of the cigar when the cigar is in a lowermost position within the storage tube, the rigid protrusion has a protrusion body and the a protrusion tip, wherein the protrusion body is constructed to extend axially into the hollow tube from the lower inside end surface of the closed second tube end and defines a gap between the protrusion body and the inside surface of the sidewall, and wherein the rigid protrusion is a distinct structure from the lower end cap and is sized to be received on the lower inside end surface and wherein the rigid protrusion includes a lower protrusion flange extending at least partially around a bottom protrusion end of the protrusion and wherein the hollow tube defines a lip constructed to trap the lower protrusion flange between the hollow tube and a lower end cap, thereby retaining the protrusion in a lower end portion of the hollow tube.

12. The storage tube of claim 11, wherein the protrusion body slopes to the protrusion tip.

13. The storage tube of claim 12, wherein the protrusion tip is rounded and has a radius of curvature from 0.1 inch to 0.2 inch.

14. The storage tube of claim 12, wherein the protrusion body is frustoconical and the protrusion tip is selected from the group consisting of a flat and a dome.

15. The storage tube of claim 11, wherein the protrusion tip has a diameter smaller than a diameter of the protrusion body.

16. The storage tube of claim 11, wherein the protrusion tip has a diameter greater than a diameter of the protrusion body.

17. The storage tube of claim 11, wherein the protrusion tip is a flat surface perpendicular to the central longitudinal axis and has a diameter from 0.15 inch to 0.3 inch.

18. The storage tube of claim 11, wherein the rigid protrusion is removable from the hollow tube and is sized to be received on the lower inside end surface.

19. The storage tube of claim 11, wherein the closed second tube end comprises the lower end cap and wherein the lower end cap is removable and includes the lower inside end surface.

20. The storage tube of claim 19, wherein the rigid protrusion is removable from the lower end cap.

* * * * *